United States Patent [19]

Ariga et al.

[11] Patent Number: 4,501,418

[45] Date of Patent: Feb. 26, 1985

[54] STACKING DEVICE FOR PAPER SHEETS

[75] Inventors: Yoshio Ariga; Toshiyuki Miyano; Yukinori Wakisaka, all of Yokohama, Japan

[73] Assignee: Tokyo Shibaura Denki Kabushiki Kaisha, Japan

[21] Appl. No.: 340,850

[22] Filed: Jan. 20, 1982

[30] Foreign Application Priority Data

Feb. 24, 1981 [JP] Japan ..... 56-24915[U]
Feb. 27, 1981 [JP] Japan ..... 56-28219

[51] Int. Cl.[3] ..... B65H 29/40; B65H 31/32

[52] U.S. Cl. ..... 271/187; 271/208; 271/189; 271/218; 271/315; 271/186; 361/212

[58] Field of Search ..... 271/187, 189, 190–192, 271/218, 315, 186, 65, 208; 361/212

[56] References Cited

U.S. PATENT DOCUMENTS

| | | | |
|---|---|---|---|
| 2,109,050 | 2/1938 | Quick et al. | 271/315 |
| 2,172,364 | 9/1939 | De Manna | 271/315 |
| 3,062,537 | 11/1962 | Hanstein et al. | 271/315 |
| 3,709,492 | 1/1973 | Baker et al. | 271/208 UX |
| 3,773,322 | 11/1973 | Schlagbauer et al. | 271/315 |
| 3,851,773 | 12/1974 | Kluge et al. | 271/315 |
| 4,060,231 | 11/1977 | Stobb et al. | 271/187 |
| 4,120,491 | 10/1978 | Lang | 271/187 |
| 4,228,997 | 10/1980 | Schoonmaker et al. | 271/315 |
| 4,357,126 | 11/1982 | Kidd et al. | 271/187 |
| 4,363,584 | 12/1982 | Kokubo | 271/315 |

FOREIGN PATENT DOCUMENTS

| | | | |
|---|---|---|---|
| 24712 | 3/1981 | European Pat. Off. | 271/208 |
| 466749 | 7/1976 | U.S.S.R. | 271/315 |

*Primary Examiner*—Bruce H. Stoner, Jr.
*Assistant Examiner*—James E. Barlow
*Attorney, Agent, or Firm*—Banner, Birch, McKie & Beckett

[57] ABSTRACT

In the stacking device for paper notes according to the present invention, the notes are successively transported edgewise and discharged from a transporting passage. Each discharged note is held between two adjacent blades of a rotating wheel, and is rotated toward a stacking box. A note edge contacting member is positioned along the path of the note as it rotates toward the stacking cradle. This note edge contacting member functions to maintain alignment of the notes by preventing projection of the notes and eliminating electrostatic charge caused by contact with the rotating blades. As a result, the notes are temporarily and evenly stacked.

6 Claims, 12 Drawing Figures

STACKING DEVICE FOR PAPER SHEETS

BACKGROUND OF THE INVENTION

This invention relates to a stacking device for paper sheets, in which sheets to be transported edgewise one by one are vertically stacked.

In recent years, with the automation of banking businesses, a currency note arranger has particularly been used. Such currency note arrangers are designed to remove currency notes one by one from a supply unit for transportation and to discriminate the notes based upon their value during transportation. After discrimination, the notes are sorted, and the reusable notes are stacked; subseqently, the stacked notes are automatically removed in predetermined numbers and bundled, and then placed in a stacking box. With these prior art systems, since the currency notes are continuously transported at high speed directly from the transportation passage into the stacking box, a succeeding note may enter the stacking box before the immediately preceding note has been completely and evenly stacked on the piled notes. As a result, the leading edge of the succeeding note may strike the immediately preceding note, thereby disturbing the evenness of the stack and skewing it. Such notes not only have an undesireable appearance but the projected notes can be torn during subsequent processing and handling.

In a conventional device, as shown in FIG. 1, to obviate the above-mentioned disadvantage, currency notes P transported from transportation passage A are held with a blade wheel B and are guided, by the rotation of blade wheel B, into a stacking box c. Blade wheel B is constructed of a plurality of blades e spaced tangentially along the circumferential surface d of wheel B. Each currency note P is held between surface d of wheel B and its respective blade e. Notes P are stacked, in order, in stacking box c even though they are continuously transported from transportation passage A at high speed. A rotating stacking mechanism f, positioned adjacent blade wheel B, has stacking cradle 1 and a pair of spaced stacking tangs g fixed to the lower edges of cradle 1. As shown in solid line, the stacking tangs g are positioned below the path of the notes which pass between transportation passage A and blade e. When a note detector j determines that a predetermined number of notes has passed into stacking box c, for example the 100th note, the stacking mechanism f, operated by motor h, starts to rotate thereby causing cradle 1 and stacking tangs g to rotate in the X direction. The movement of stacking tangs g is then stopped in the position shown by the dotted line, thereby preventing succeeding notes from being stacked directly onto the preceding predetermined number of notes. The immediately succeeding notes are then temporarily stacked on tangs g. While the preceding currency note group (i.e., 100 notes) in stacking box c is feed into a bundling unit, rotating stacking tangs g stack the succeeding currency notes. After the notes in stacking box c are emptied, stacking tangs g are again rotated in direction X to transfer the temporarily stacked notes on tangs g into stacking box c. The development of a stacking mechanism f permitted the currency notes to be continuously processed, without stopping the device, thereby increasing its efficiency.

This prior art system, however, had certain disadvantages. Each blade e as it rotates presses the top positioned currency note P among the temporarily stacked notes on stacking tangs g such that it rides up cradle 1. When each blade rotates past its contact position with the top note, the reaction force of the note flings the note from cradle 1 and shifts it projectedly from the other stacked notes on tangs g. Further, due to the rubbing action of blades e against the top positioned note as they rotate past, the note is electrostatically charged. As a result, the shifted notes are prevented from stacking evenly due to the difficulty in overcoming the electrostatic forces. Therefore, the stacked notes transported from stacking tangs g and stacked in stacking box c are unevenly stacked.

In conventional devices, moreover, new notes which are stiff and subject to significant friction between the blades and the surface of the wheel. As a result, such notes will not be securely positioned, as they are transported, between the blades and can result in uneven stacking.

BRIEF DESCRIPTION OF THE INVENTION

It is an object of the invention to overcome the prior art disadvantages mentioned above. The invention provides a stacking device for paper sheets transported from a transporting passage, whereby the paper notes are evenly stacked even if the notes are electrostatically charged by the rotation of the blades.

Another object of the invention is to provide a stacking device for paper sheets wherein the stacked sheets are evenly stacked, even if new notes are utilized.

A further object of the invention is to provide a stacking device for paper sheets wherein the sheets are successively stacked.

In the stacking device for paper notes according to the present invention, the notes are successively transported edgewise and discharged from a transporting passage. Each discharged note is held between two adjacent blades of a rotating wheel, and is rotated toward a stacking box. The note then strikes a finger type stop wall of the stacking box which dislodges the note from the blades and it then falls, by gravity, into the stacking box. When a predetermined number of notes (e.g., 100 notes) are stacked, a stacking cradle is rotated into position. The stacking cradle comprises an inner and outer side wall and a convoluted stop member which joins the side walls. A pair of spaced support tangs are cantilevered from the outer ends of the stop member. The two spaced stacking tangs are stopped above the stacking box to receive the succeeding notes. When the stacking cradle is positioned above the stacking box, the 101st and succeeding notes strike convoluted stop member and are temporarily stacked on the stacking tangs. As a result, the succeeding notes are separated from the 100 sheets of notes previously stored in the stacking box.

A note edge contacting member is positioned along the path of the note as it rotates toward the stacking cradle. This note edge contacting member functions to maintain alignment of the notes by preventing projection of the notes and eliminating electrostatic charge caused by contact with the rotating blades. As a result, the notes are temporarily and evenly stacked on the stacking tangs.

The instant invention includes additional means which forces the note to move further down between the blades to securely position it until it is removed by the finger type stop wall. This additional means uses constant force to further position the notes. As a result, the force of each note as it strikes the stop member of the stacking cradle is constant; this offers additional assistance in positioning the notes evenly on the sectional stacking plate.

Furthermore, the note edge contacting member is constructed of a conductive material and grounded; consequently, static electricity formed on the notes caused by the contacting rotating blades, is eliminated. Eliminating the charge not only permits the notes to be evenly stacked but also prevents adherence of the notes to the note edge contacting member. Thus, there will be no shortage in the number of notes guided into the stacking box. The instant invention, therefore, produces evenly stacked notes which have a desirable appearance and will unlikely be torn during subsequent processing and handling by, for example, automatic bundling machines.

Other objects and features of this invention will be apparent from the following description read in connection with the accompanying drawings.

BRIEF DESCRIPTION OF THE DRAWINGS

FIG. 4(*b*) is a sectional view of a stacking device along lines 4*b*—4*b* shown in FIG. 4(*a*);

DETAILED DESCRIPTION OF THE INVENTION

Figure 1:
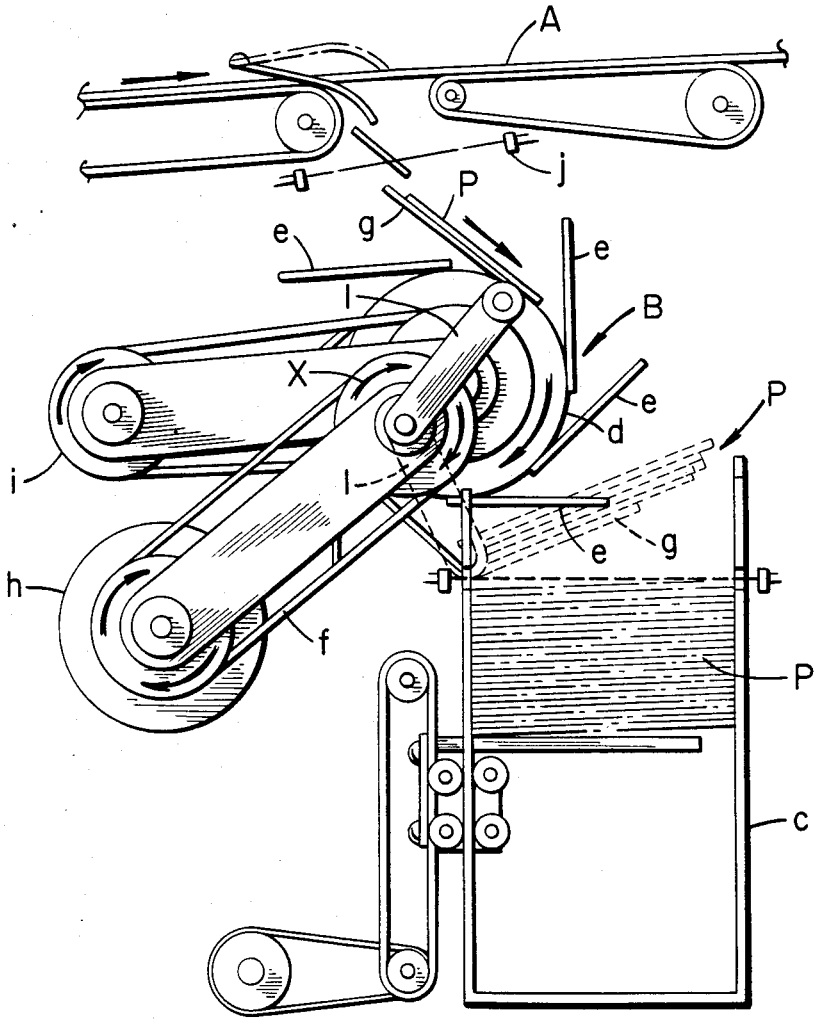
FIG. 1 PRIOR ART
FIG. 1 is a schematic side elevation of a conventional stacking device for stacking paper notes.
Figure 2:
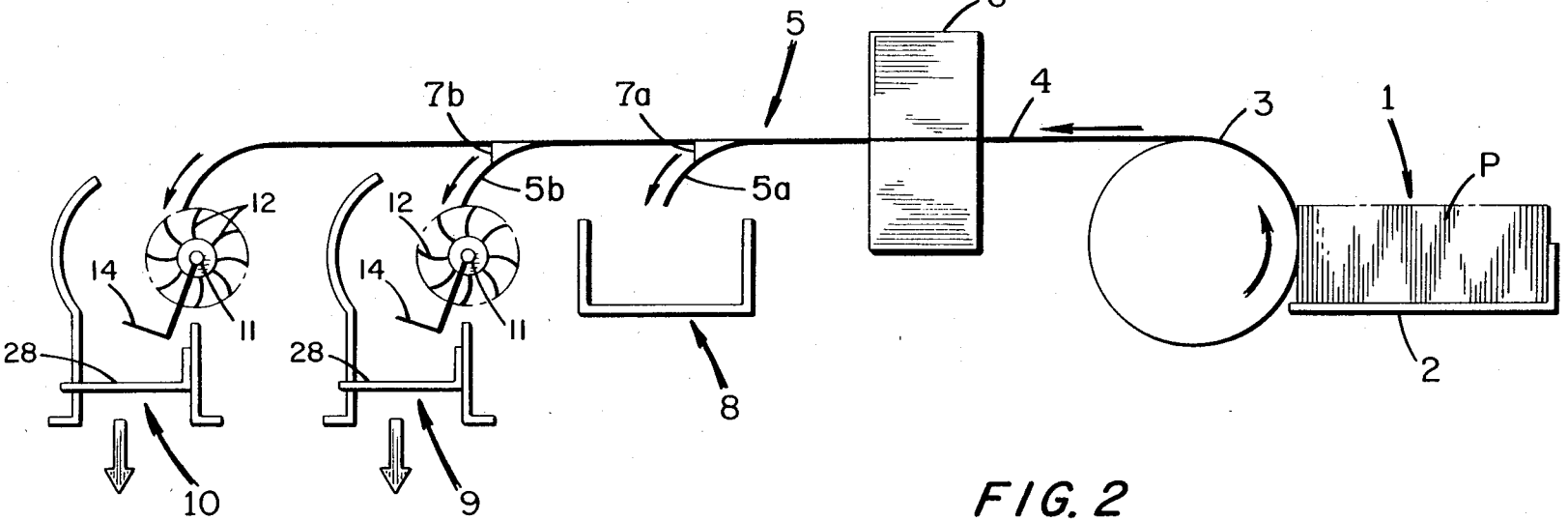
FIG. 2 is a diagram of a currency note arranger utilizing a paper note stacking device according to the present invention.
Figure 4B:
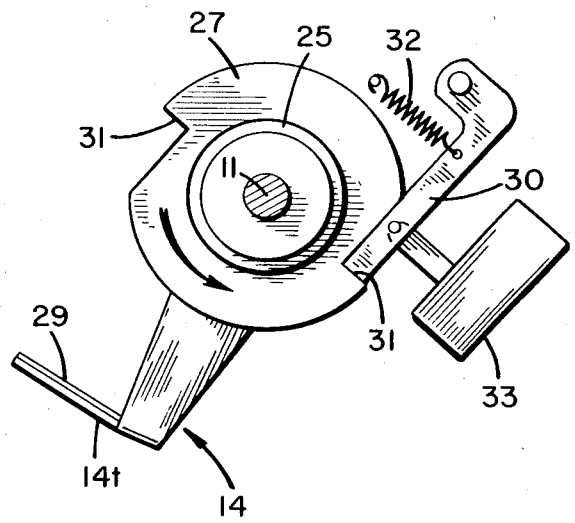
FIG. 4(*a*) is a schematic front elevation partially in section of the paper note stacking device shown in FIG. 3.
Figure 4A:
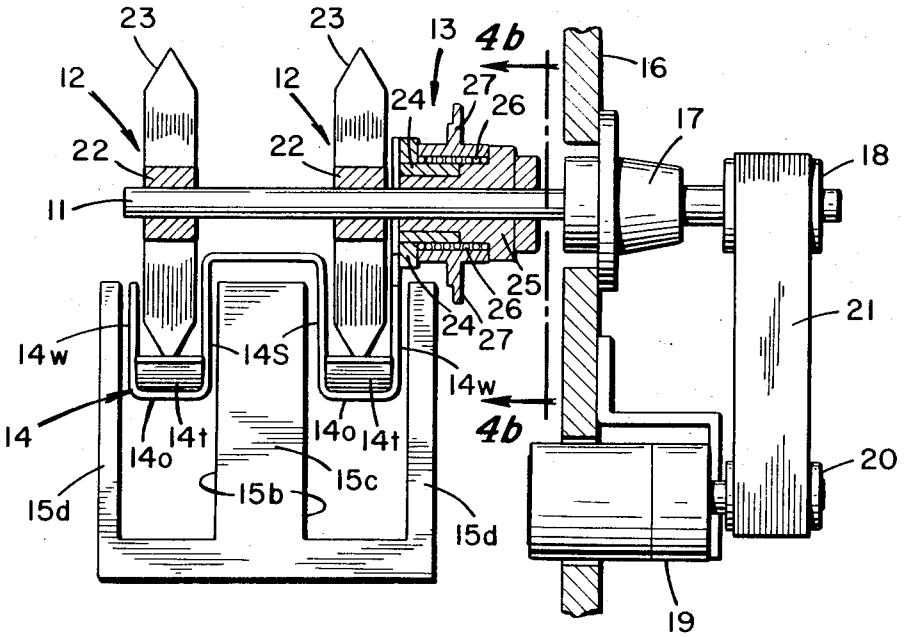
Figures 3, 6:
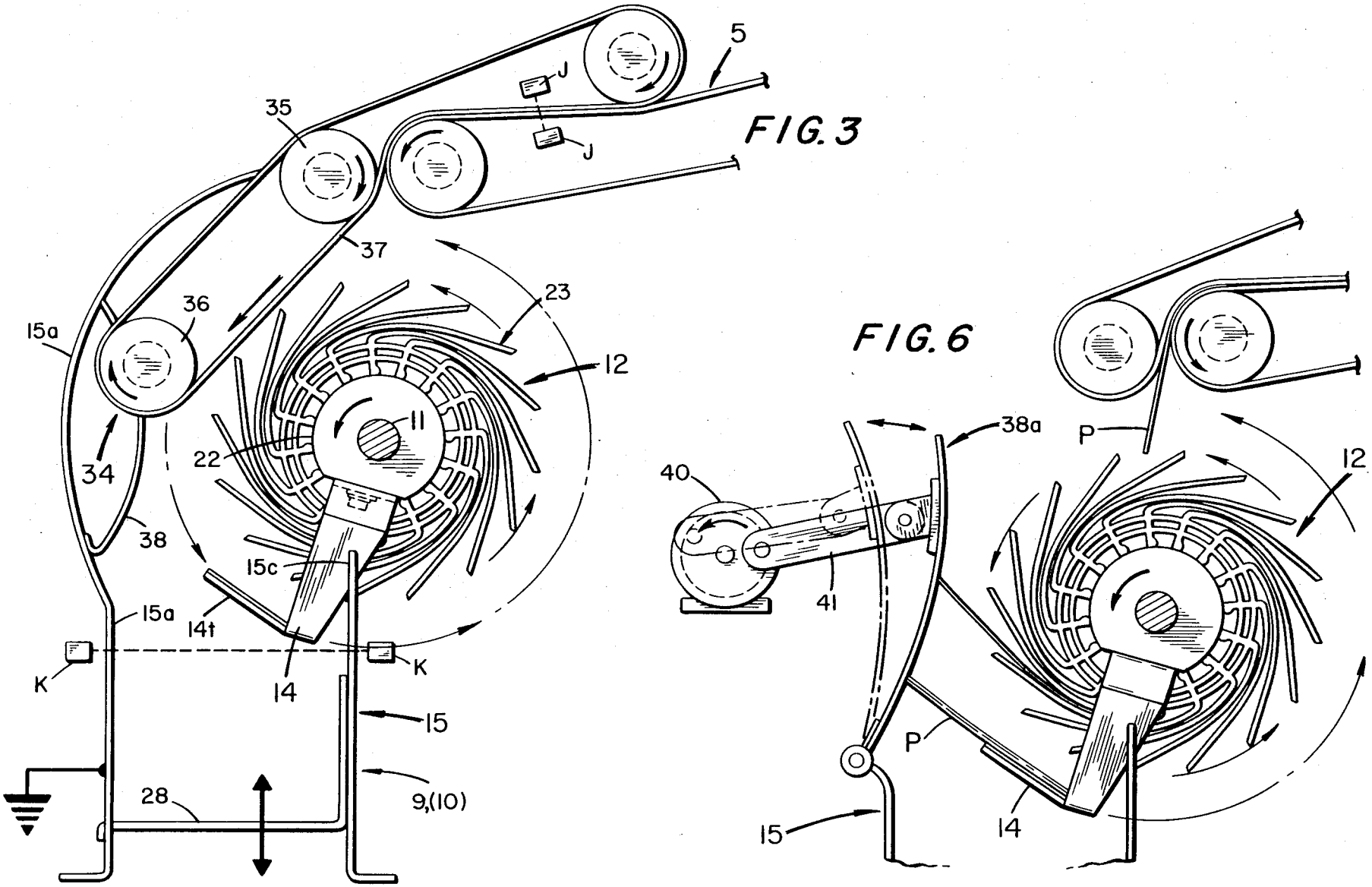
FIG. 3 is a vertical sectional view of the paper note stacking device shown in FIG. 2.
FIG. 6 is a side elevational view showing the operation of a paper note stacking device of another embodiment of the present invention.

As shown in FIG. 2, paper money such as currency notes P are vertically stored in a supply box 2 of a supply unit 1. The notes are successively supplied with rotation of a feeding rotor 3 along a transporting passage 5. Currency note P is transported by transporting belts 4 which transports each note P at the speed of 16 m/sec. Along transport passage 5, note P is read by a discriminating unit 6 for discriminating reusable notes from unusable notes. An electric signal from discriminating unit 6 controls a first sectional gate 7*a* and a second sectional gate 7*b*. First sectional gate 7(i a is utilized for receiving currency notes which were not discriminated by discriminating unit 6 (i.e., unusable notes: skewed notes and overlapped notes, and counterfeit notes). A first stacking unit 8 receives these ususable notes via branch 5*a*. Second sectional gate 7*b* is utilized for stacking reusable notes which were discriminated by unit 6. A second stacking unit 9 receives these usable notes via branch 5*b*. Third stacking unit 10 is positioned facing the end of transport passage 5 for stacking unfit notes such as dirty notes, partially torn notes and notes which have cellophane tape. First stacking unit 8 is a mere container for receiving the notes, while the units 9 and 10 have identical constructed and utilize the stacking features according to the present invention. Each unit's construction, as shown in FIGS. 3 and 4, comprises: spaced blade wheels 12 coupled on shaft 11; a stacking cradle 14 provided on shaft 11 via a clutch mechanism 13; a feeding member 34 provided near blade wheel 12; and a note edge contacting member provided on stacking box 15.

Shaft 11 is supported by a supporting frame 16 via a shaft bearing 17; the shaft end portion receives a pulley 18. Supporting frame 16 also receives a pulley driving motor 19. A belt 21 is coupled between a driving pulley 20, attached to a shaft of motor 19, and pulley 18, for transmitting rotating energy to shaft 11. Each set of spaced blade wheels 12 comprises a ring-shape wheel 22 which retains a number of blades 23 radially projected is in a fixed angular position along the surface of wheel 22. Blades 23 are spirally formed so that the inner ends of adjacent blades are closer together than the outer ends of adjacent blades. Each blade 23 is rotated at a speed of 0.65 m/sec.

Clutch mechanism 13 is, for example, a spring clutch and comprises: an input hub 25 for coupling to shaft 11; an output hub 24, coupled to a portion of the outer peripheral surface of input hub 25, which is mounted directly to stacking cradle 14; a coil spring 26 wound on a portion of the peripheral surfaces of input hub 25 and output hub 24; and, stopping gear 27 engaging with coil spring 26. As shown in FIG. 4(*b*), gear 27 has two notches 31 positioned at intervals of substantially 180°. A lever 30 is retracted by solenoid 33 and projected by spring 32. When projected, lever 30 engages the notch 31 of gear 27. When lever 30 engages notch 31, stopping gear 27 prevents further rotation of output hub 24. Upon activating solenoid 33, lever 30 disengages notch 31; gear 27 can rotate freely. Consequently, coil spring 26 transmits the rotating energy from input hub 25 to output hub 24 causing the rotation of stacking cradle 14.

Stacking cradle 14 comprises inner and outer parallel spaces side walls 14*w*. The inner side wall radially projects at one end from output hub 24. Cradle 14 also comprises a convoluted stop member joined to the other end of each side wall. The convoluted stop member also includes: a centrally upwardly projecting portion 14S that extends between blades wheels 12, and two outer portions 14*o* which join the central portion and the side walls. All the elements of cradle 14 define a pair of spaced U-shaped members through which blades 23 pass as they rotate outer portion 14*o* receives a pair of spaced support tangs 14*t*, each contilevered at one end from each outer portion 14*o* in the angular direction of blades 23. Each support tang 14*t* has a friction pad 29 which securely maintains the notes on the surface of the tang as it temporarily stacks the succeeding notes. Pads 29 are composed of a material having a high coefficiency of friction, such as rubber.

Stacking box 15 comprises one curved side wall 15*a* and an opposite finger-like configured side wall. Side wall 15*a* is outwardly curved to prevent the notes from contacting the wall as they are rotated toward the stacking box. Side wall 15*a* is made of stainless steel and is grounded as shown in FIG. 3. The opposite side wall has notched portions 15*b* which provides a finger-like configuration having upwardly projecting outer finger portions 15*d* and a central upwardly projecting finger stop portion 15*c*. This configuration permits the blades 23 and cradle 14 to pass through this side wall as they are rotated. The position of finger stop portion 15*c* interrupts further rotational movement of the notes as they move past the wall. Stacking box 15 further comprises a receiving plate 28 which can be moved upwardly or downwardly in response to a signal received from photoselector K. If the position of plate 28 is such that the uppermost currency note P, stacked on receiving plate 28, is detected by photoelectric detector K, in that event plate 28 will be moved downwardly to permit it to receive more notes. If no signal is received, plate 28 will be moved upwardly to a predetermined position. Also, receiving plate 28 is moved downwardly to remove the stacked currency note group (e.g., 100 notes) from stacking box 15 when a predetermined number is counted by detector J. The instant invention also utilizes an additional structure along the transportation path 5 of the notes. In particular, a feeding member 34 is utilized which increases the acceleration of the notes and forces them more securely between blades 23. Feeding member 34 comprises a feeding belt 37 arranged between roller 35 and roller 36. Roller 35 is positioned substantially along a vertical axis extending above shaft 11. Roller 36 is positioned substantially along a horizontal axis extending from shaft 11. Feeding belt 37 is positioned sufficiently close to rotary wheel 12 so that the ends of blades 23 touch belt 37 as they rotate. The linear speed of feeding belt 37 is made greater than the linear tangential velocity at the tip of blades 23 so that the notes contacting belt 37 are accelerated.

Attached to the outwardly curved wall 15*a* of stacking box 15 is a note edge contacting plate 38 constructed of inwardly curved stainless metal. As shown in FIG. 3, plate 38 is likewise grounded. The radius of curvature of plate 38 is designed so that the edges of the notes will continually contact plate 38 during the time stacking cradle 14 receives notes from rotating blades 23. This continued contact between the notes and plate 38 prevent the notes from being projected by the rotating contact of the blades against the top positioned curving note.

Reference is now made to FIGS. 3 and 5 to explain the operation of stacking cradle 14. As shown in FIGS. 3 and 5(*a*), paper notes P are successively transported along transporting passage 5 toward blade wheel 12 rotating in the indicated direction. The entry of each note P along the passage is detected by a photoelectric detecting unit J. Clutch mechanism 13 functions so that stacking cradle 14 is held in position just before the central finger stop 15*c* of stacking box 15. That is, lever 30 engages notch 31 of gear 27 to prevent rotation of gear 27, and spring 26 is opened to release the connection of input hub 25 and output hub 24, as shown in FIG. 4(*a*). A leading edge of the note P is then inserted between adjacent blades of blade wheel 12 and is then rotated by wheel 12.

As shown in FIG. 5(*b*), as note P is transported from transport passage 5, its trailing edge is immediately contacted by feeding belt 37. Since the linear speed of feeding belt 37 is greater than the linear tangential speed of the blade tips, the note is accelerated downwardly which forces and more securely positions the note between the blades. The present invention has particular application to new notes. Such notes are stiff and have significant friction between blades 23. The utilization of feeding belt 37 helps overcome this friction by additionally forcing the notes between blades 23.

Furthermore, note edge contacting plate 38 helps maintain these new notes in position. New paper money has a significant resiliency such that when the notes strike wheel 22 they will spring back with virtually the same force used in feeding between the blades. Thus, the notes can be projected beyond the position whereby the notes are secured between the blades. However, as the new paper money touches note contacting plate 38, the projected end of paper money P is forced toward the blades by the gradual pushing action exerted by plate 38 and the note is thus inserted deeply between the blades.

Figure 5B:
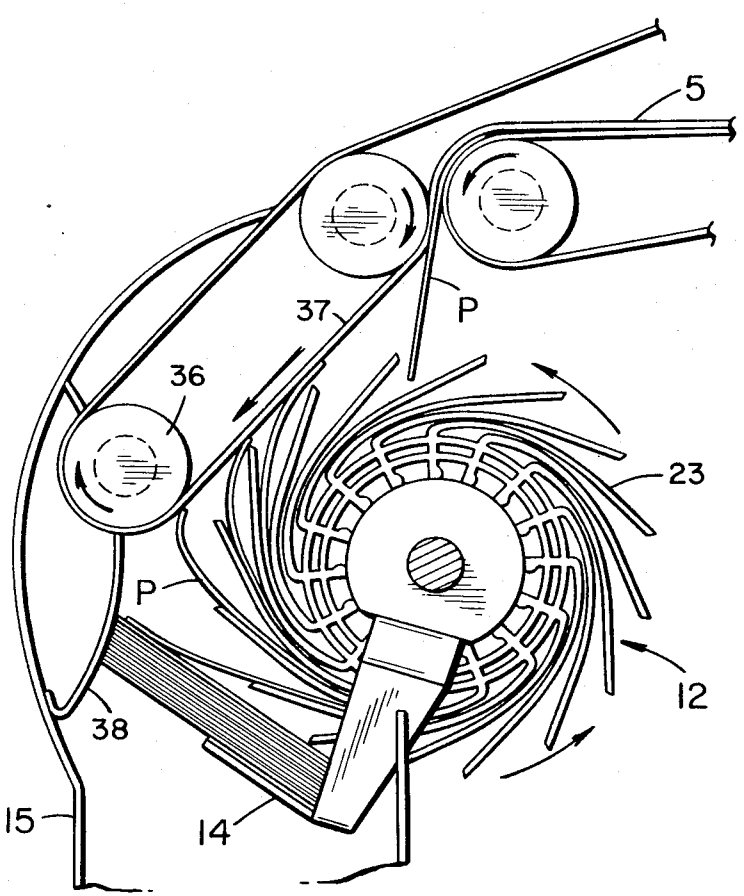
FIGS. 5(*a*)–(*f*) are views, similar to FIG. 3, showing the movement of the paper note as it is tranported by the stacking device shown in FIG. 3.
Figure 5A:
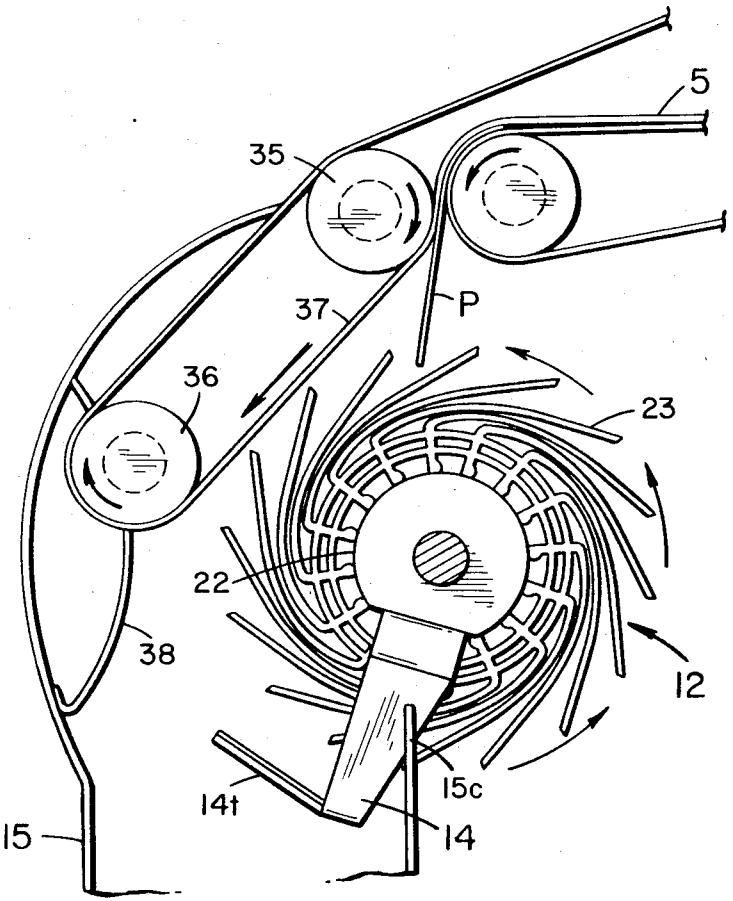

Continuing with the discussion of stacking cradle 14, all the notes are transported to and stacked on, stacking tangs 14*t*, as shown in FIG. 5(B). While on stacking tangs 14*t*, the top positioned note is contacted by blades 23 as they rotate past. As a result, the top positioned note is forced back from cradle 14 and urged from the other stacked paper money. However, the trailing edge of this top positioned note is stopped from being forced away from cradle 14 by note contacting plate 38. Furthermore, although this top positioned note has become electrostatically charged, due to the rubbing action of blades 23 as they pass the temporary stacked notes, the charges are removed by plate 22 and grounded. As a result, the notes on cradle 14 are evenly stacked.

Figure 5D:
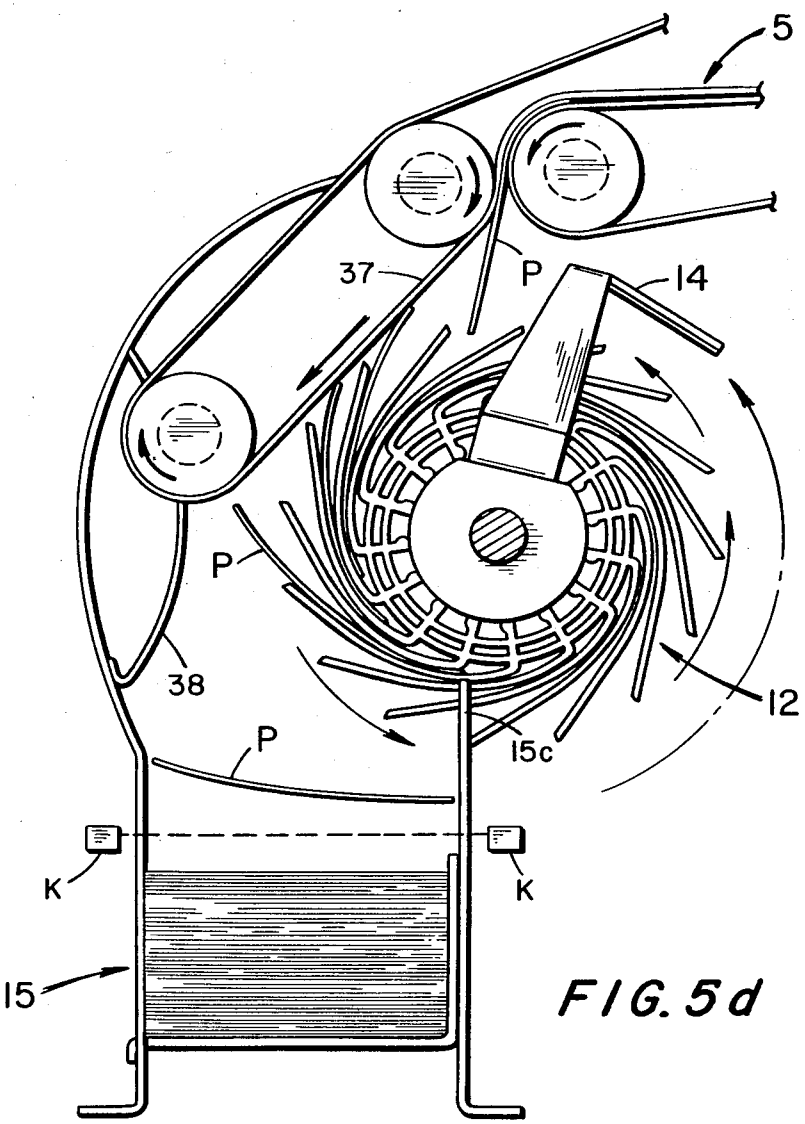
Figure 5C:
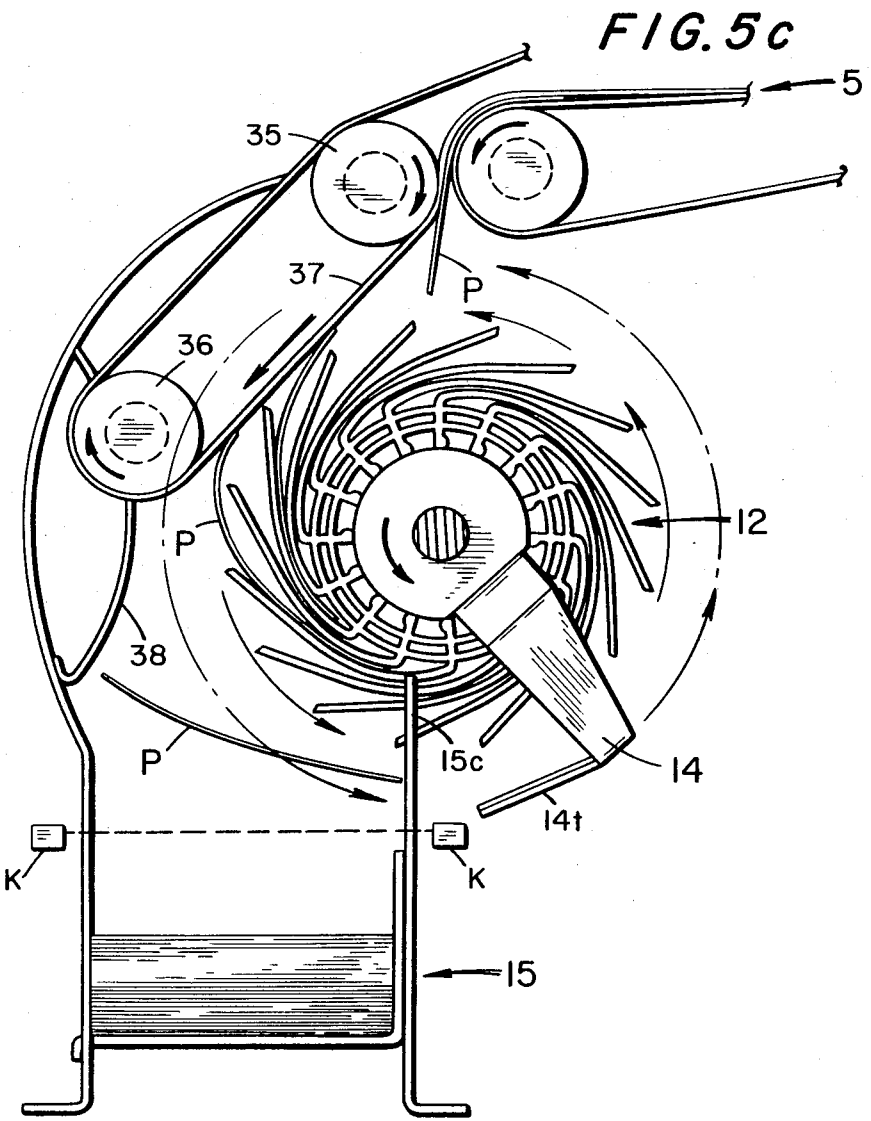

When the predetermined amount of notes have entered passage 5 (e.g., the 60th paper), it is detected by photoelectric detecting unit J—J. At that time, solenoid 33 is energized nd lever 30 is released from notch 31, thereby releasing gear 27 of clutch mechanism 13. Spring 21, in turn, provides the rotating force of input hub 25 to output hub 24, and the rotating force of shaft 11 is applied to stacking cradle 14. As a result, as shown in FIG. 5(C), stacking cradle 14 is rotated with wheel 12. As stacking cradle 14 passes finger stop portion 15*c* of stacking box 15, the temporarily stacked notes P on stacking cradle 14 strike finger portion 15*c* and are removed from tangs 14*t*; the notes then drop on receiving plate 28. The notes subsequently transported by blade wheel 12 are directly stacked, without the aid of stacking cradle 14, on the notes already positioned on receiving plate 28. As shown in FIG. 5(D), as stacking cradle 14 continues its rotation and the end of transport passage 5, gear 27 is positioned as that lever 30 engages notch 31; as a result, the connection of input hub 25 and output hub 24 is released, no turning force is given to output hub 25, and stacking cradle 14 stops its rotating movement. Blade wheel 12 continues to rotate to guide the succeeding paper notes P into stacking box 15.

Figure 5F:
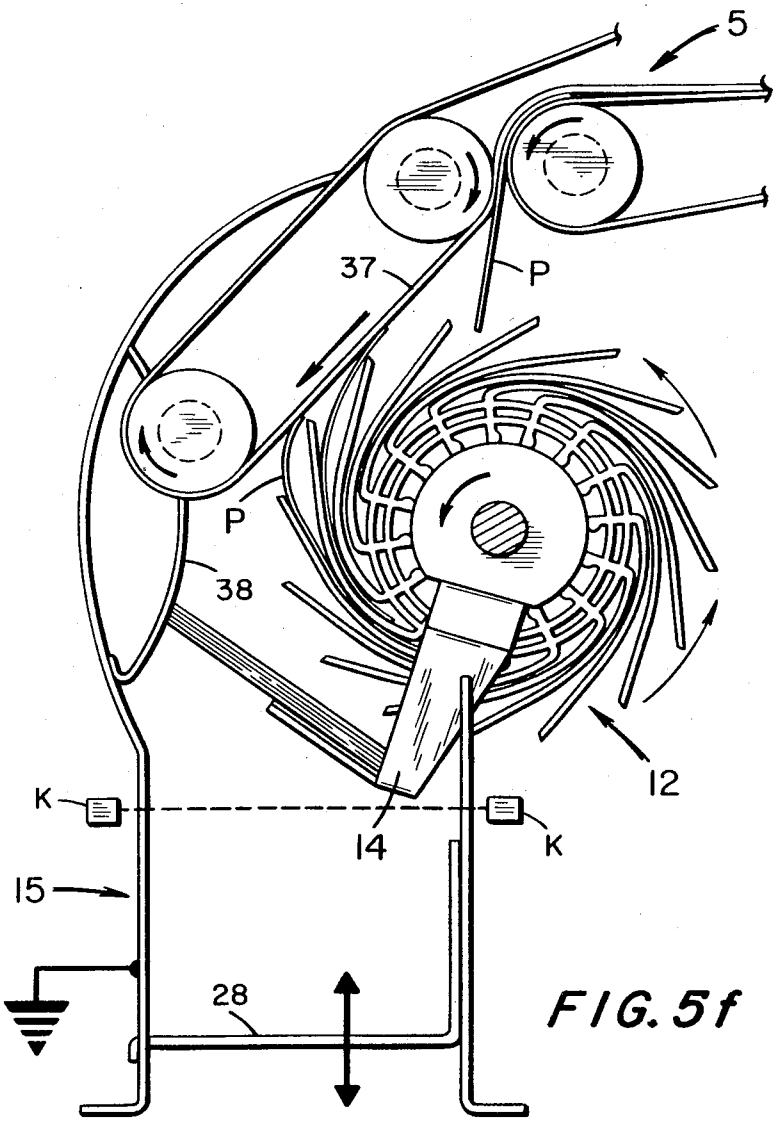
Figure 5E:
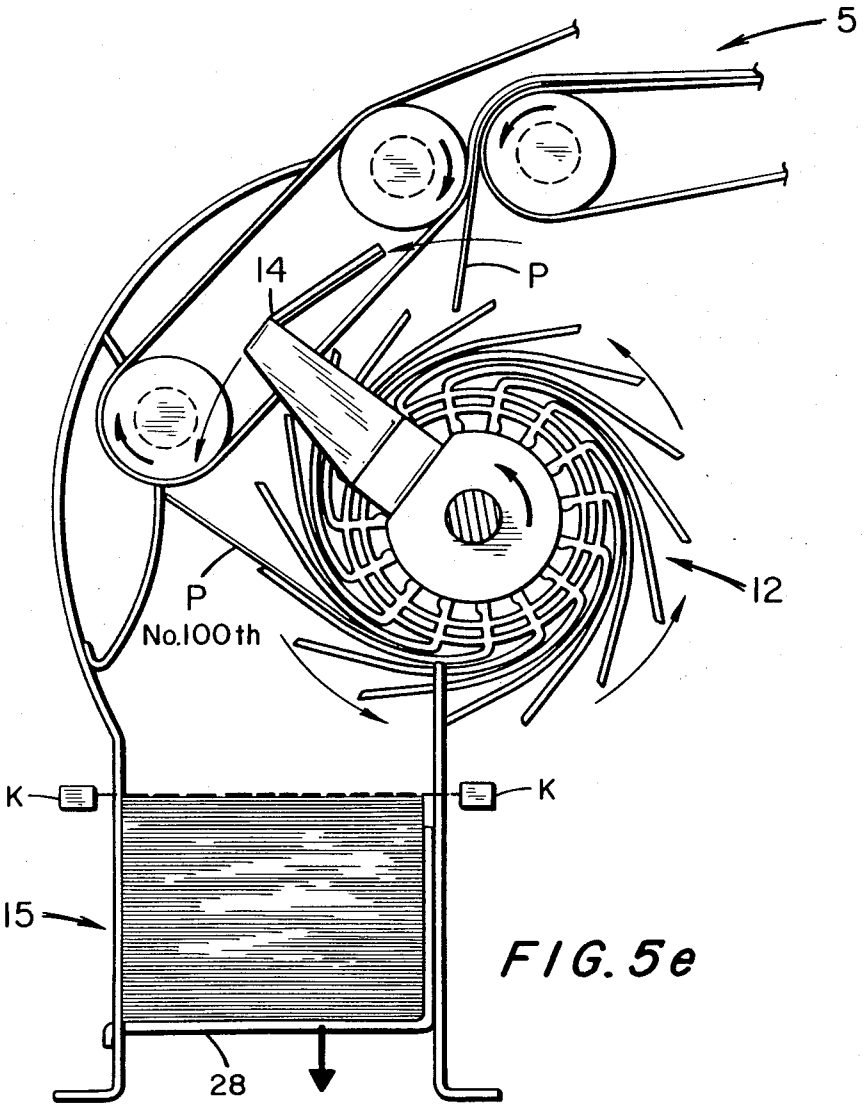

Stacking cradle 14 remains in the position shown in FIG. 5(D) until the second predetermined number of notes (e.g., the 100th note) are detected by photoelectric detecting J. As shown in FIG. 5(E), when the entry of the 100th note P on passage 5 is detected by detecting unit J, solenoid 33 is temporarily energized to disengage lever 30 from gear 27. As a result, the stacking cradle 14 is rotated. Before the 101st paper note P is transported from transport passage 5, stacking cradle 14 passes beyond the opening of transport passage 5. As shown in FIG. 5(F), when stacking cradle 14 reaches the original position (just before finger stop portion 15*c*), lever 30 engages gear 27 and stacking cradle 14 stops moving. The succeeding notes are then stacked on stacking cradle 14. When a third predetermined number of notes (e.g., the 105th paper) is detected by photoelectric detector J—J, a takeout mechanism (not shown) operates to remove the 100 notes on receiving plate 28; they are then sent to a bundling unit (not shown) for bundling. The cycle is then repeated as mentioned above. The note edge contacting member of the present invention is not limited to a stationary curved structure. As shown in FIG. 6, a movable note edge contacting plate 38*a* is connected with a driving motor 40 through a connecting lever 41. Movable plate 38*a* functions to forcibly contact the paper money held between blades 23 to securely position them and contact the edges of paper notes on stacking cradle 14 thereby preventing any unevenness caused by the notes being projected from the cradle.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention.

We claim:

1. A stacking device for evenly stacking paper notes successively along and discharged from a transport passage, each of said notes having a leading edge and a trailing edge, said stacking device comprising:

note transporting means for engaging the discharged notes at their leading edges and pulling the notes along a transporting path to a stacking box;

cradle means positioned along said transporting path and having a first operative position for temporarily receiving and stacking the notes from said transporting means and depositing said temporarily stacked notes in said stacking box;

note edge contacting means for contacting the trailing edge of each of said notes for securing said notes in engagement with said note transporting means as said notes are being pulled along the transporting path to said stacking box, said note contacting means further contacting the trailing edge of each of said notes as said notes are received and stacked on said cradle means to maintain an evenly stacked pile, said note edge contacting means being convex toward the transporting path; and note removing means for removing each of said notes from said transporting means and depositing said notes into said stacking box when said cradle means is away from said first operative position.

2. Stacking device as claimed in claim 1 wherein said note edge contacting means is made of a conductive material and is provided with a static electricity removing means for removing any static electricity existing on the temporarily stacked notes.

3. Stacking device as claimed in claim 1 wherein said note edge contacting means and has a radius of curvature such that the trailing edges of the notes continually contact it.

4. Stacking device as claimed in claim 1 wherein said stacking box is made of a conductive material and is provided with a static electricity removing means for removing any static electricity existing on the notes stacked in the stacking box.

5. The stacking device of claim 1 further comprising:

note accelerating means positioned adjacent said transporting means for contacting the trailing edge of each of said notes and urging the leading edge of each of said notes further into engagement with said transporting means.

6. Stacking device as claimed in claim 5 wherein said transporting means comprises a rotating wheel having a plurality of outwardly projecting blades, said note accelerating means comprising a transporting belt having a linear speed which is greater than the linear tangential velocity at the tips of said blades.

* * * * *